US009108078B1

(12) United States Patent
Young

(10) Patent No.: US 9,108,078 B1
(45) Date of Patent: Aug. 18, 2015

(54) TOTAL BODY CONDITIONING EXERCISE APPARATUS

(71) Applicant: James N. Young, Spring, TX (US)

(72) Inventor: James N. Young, Spring, TX (US)

( * ) Notice: Subject to any disclaimer, the term of this patent is extended or adjusted under 35 U.S.C. 154(b) by 201 days.

(21) Appl. No.: 13/776,054

(22) Filed: Feb. 25, 2013

Related U.S. Application Data

(60) Provisional application No. 61/744,612, filed on Oct. 1, 2012.

(51) Int. Cl.

| | |
|---|---|
| ***A63B 21/00*** | (2006.01) |
| ***A63B 21/02*** | (2006.01) |
| ***A63B 21/05*** | (2006.01) |
| ***A63B 21/04*** | (2006.01) |
| ***A63B 23/035*** | (2006.01) |

(52) U.S. Cl.
CPC ..... *A63B 23/03575* (2013.01); *A63B 21/023* (2013.01); *A63B 2208/0257* (2013.01)

(58) Field of Classification Search
CPC ..... A63B 2208/0257; A63B 21/023; A63B 23/03575
USPC ..... 482/56, 92, 115, 121–123, 125, 482/128–130, 133–139, 140, 148, 907
See application file for complete search history.

(56) References Cited

U.S. PATENT DOCUMENTS

| | | | | |
|---|---|---|---|---|
| 326,247 | A * | 9/1885 | Root | 482/56 |
| 1,518,361 | A * | 12/1924 | Ruden | 482/128 |
| 1,548,849 | A * | 8/1925 | Ruden | 482/128 |
| 1,950,174 | A * | 3/1934 | Harrison | 482/130 |
| 4,809,976 | A * | 3/1989 | Berger | 482/130 |
| 4,844,450 | A | 7/1989 | Rodgers, Jr. | |
| 5,007,632 | A * | 4/1991 | Wilkinson | 482/72 |
| 5,158,513 | A | 10/1992 | Reeves | |
| 5,224,909 | A * | 7/1993 | Hamilton | 482/70 |
| 7,318,791 | B2 | 1/2008 | Akhmetov | |
| 7,530,936 | B1 | 5/2009 | Hall | |
| 7,585,263 | B2 | 9/2009 | Brown et al. | |
| 7,722,512 | B2 * | 5/2010 | Liang et al. | 482/130 |
| 8,137,250 | B1 * | 3/2012 | Caban | 482/140 |
| 2004/0167000 | A1 * | 8/2004 | Schwarz | 482/123 |
| 2010/0248919 | A1 * | 9/2010 | Zhou et al. | 482/139 |

* cited by examiner

*Primary Examiner* — Oren Ginsberg
*Assistant Examiner* — Joshua Lee
(74) *Attorney, Agent, or Firm* — Egbert Law Offices, PLLC

(57) ABSTRACT

An exercise apparatus has a frame, a pair of arm resistance assemblies supported by the frame adjacent one end of the frame, a pair of leg resistance assemblies supported by the frame adjacent an opposite end of the frame, and a torso support platform supported by the frame and having a surface thereon suitable for supporting a human torso thereon. Each of the pair of arm resistance assemblies having a surface suitable for receiving a human hand thereon. The pair of arm resistance assemblies are operable independently of each other. Each of the pair of leg resistance assemblies has a surface suitable for receiving a human foot thereon. The leg resistance assemblies are operable independently of each other.

15 Claims, 3 Drawing Sheets

TOTAL BODY CONDITIONING EXERCISE APPARATUS

CROSS-REFERENCE TO RELATED APPLICATIONS

The present application claims priority from U.S. Provisional Patent Application Ser. No. 61/744,612, filed on Oct. 1, 2012 and entitled "Fish and Kangaroo Full Body Exercise Device".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to exercise devices. More particularly, the present invention the relates to exercise devices which provide exercise simultaneously to the arms, legs and torso. Additionally, the present invention relates to exercise device which include leg resistance assemblies and arm resistance assemblies that are mounted in a common plane.

2. Description of Related Art Including Information Disclosed Under 37 CFR 1.97 and 37 CFR 1.98

There are many different types of exercise equipment available to a user. A person will normally have some goal in mind as to which muscles he or she wishes to improve. The user will then choose the particular machine or apparatus accordingly. For example, barbells are used to strengthen the arms and upper torso. A leg press is effective for improving a user's leg muscles. For a user wishing to improve the mid-body muscles of the lower back and abdomen, there are two primary types of devices for this purpose. These devices require the user to either perform a sit-up motion or a rowing motion.

Sit-up devices normally include one portion that restrains the user's ankles and another portion that supports the user's body in a supine position. These devices commonly are in the form of an elongated platform that has a "T"-shaped ankle securing member proximate one end. The end of the platform may be attached at any one of a number of vertically-spaced points to a vertically-oriented support.

The second form of machine for improving a user's mid-body muscles is typified by a rowing machine. In this type of device, the user sits atop a support (often horizontally movable) and pulls back with his or her arms and upper body against a resistance.

Unfortunately, in order to achieve total body conditioning, these various exercise devices must be used separately. There is no particular apparatus that improves both the upper and lower muscles while, at the same time, improving the mid-body muscles. Additionally, there are no existing exercise devices that provide correct natural movement, incremental and constant resistance and constant motion, and no negative impact on the individual's body. Through the use of various separate appliances, the person exercising may achieve conditioning of particular muscles, but not generalized muscle groups. As such, as the biceps are improved with traditional exercise devices, those muscles, tendons, and support structures are generally not strengthened. As such, there would be a "weak link" in the overall body muscular and skeletal chain. As such, the total body conditioning is not able to be achieved.

In the past, various patents have issued relating to exercise devices. For example, U.S. Pat. No. 4,844,450, issued on Jul. 4, 1989 to R. E. Rodgers, Jr., shows an exercise device for simulated swimming strokes. A cabinet is supported on a frame and serves as a base which has a body supporting platform thereabove. One portion supports the torso and parallel duplicate hinge portions support the legs of the user. The user's arms reciprocate cable means and the user's legs reciprocate pivotal push rods extending into the cabinetry for rotating power consuming means. These power consuming means can be independent arm- and leg-powered flywheels respectively connected to arm and leg powered means.

U.S. Pat. No. 5,158,513, issued on Oct. 27, 1992 to M. P. Reeves, shows a swimming exercise and training apparatus that has a base arrangement disposed on a supporting surface. A support member has a longitudinal axis secured in-line with and in a substantially horizontal position to the base arrangement in a spaced relationship thereabove. A head support is provided for a user's head which is secured to a first portion of the support member capable of independent rotation about the longitudinal axis. A chest support is provided for the user's chest and is secured to a second portion of the support member spaced from the head support capable of independent rotation about the longitudinal axis. A hip support is provided for the user's hips and is secured to a third portion of the support member spaced from the chest support. A leg support is pivotally secured to a fourth portion of the support member and spaced from the hip support so as to allow the user to simulate swimming leg movements.

U.S. Pat. No. 5,224,909, issued on Jul. 6, 1993 to J. R. Hamilton, discloses a bi-level exercise apparatus in which a user assumes a crawling position and then moves arm and leg receiving slides in a back-and-forth motion. The slides are attached to tracks that constrain the movement of the slides to a linear-horizontal path. A gear train assembly provides resistance to the rearward movement of the slides but allows the slides to move in a forward direction substantially without resistance.

U.S. Pat. No. 7,318,791, issued on Jan. 15, 2008 to Z. Akhmetov, discloses a cardiovascular spine exerciser that has a bearing framework with fore and rear pivot points, a pair of hand striding units and a pair of foot striding units pivotally mounted to corresponding fore and rear pivot points and depending downwardly therefrom, and a kinematic transmission connecting the left and right pairs of the striding units so as to swing the striding units in opposite directions.

U.S. Pat. No. 7,530,936, issued on May 12, 2009 to A. A. Hall, teaches an exercise machine having a bench top with an upper support surface. There is a rear leg fixedly attached to and extending downwardly from the bench top's rearward end. The exercise machine has a "J" leg with a stem section and a tail section. The exercise machine also has at least a first arm with a proximal end and a distal end. The proximal end of the at least first arm is pivotally attached to the distal end of the "J" leg's tail section. There is a handle fixedly attached to the distal end of the first arm. A free weight bar is fixedly attached to the distal end of the first arm.

U.S. Pat. No. 326,247, issued on Sep. 15, 1885 to J. B. Root, discloses an exercise machine having a pair of arm members and a pair of foot members that are connected to cables by flywheels. A support section is provided in the center thereof so as to support the torso of the user.

U.S. Pat. No. 7,585,263, issued on Sep. 8, 2009 to Brown et al., provides an abdominal exercise machine for working the abdominal and oblique muscle groups. The abdominal exerciser includes a carriage connected to a frame by a swing-arm that allows the carriage to swing along an arcuate path. The carriage is connected to the frame by non-parallel first and second swing-arms. The carriage is adjustable to accommodate users of different sizes and to isolate different abdominal muscle groups. The abdominal exerciser device is designed to simulate an abdominal exercise "crunch" motion when the knees are brought within proximity of an upper body support.

It is an object of the present invention to provide a total body conditioning exercise apparatus that allows for a correct natural movement of the human body.

It is another object of the present invention to provide a total body conditioning exercise apparatus that provides incremental and constant resistance with constant motion.

It is a further object of the present invention to provide a total body conditioning exercise apparatus that has no negative impact on the individual's body.

It is another object of the present invention to provide a total body conditioning exercise apparatus that improves cardio, strength, reaction time and joint conditioning.

It is still another object of the present invention to provide a total body conditioning exercise apparatus that reduces stress levels, and reduces muscle breakdown and tear down that is associated with standard exercise equipment.

These and other objects and advantages of the present invention will become apparent from a reading of the attached specification and appended claims.

BRIEF SUMMARY OF THE INVENTION

The present invention is an exercise apparatus that comprises a frame, a first pair of arm resistance assemblies supported by the frame adjacent one end of the frame, a pair of leg resistance assemblies supported by the frame adjacent an opposite end of the frame, and a torso support platform supported by the frame and having a surface thereon suitable for supporting a human torso thereon. Each of the pair of arm resistance assemblies has a surface suitable for receiving a human hand thereon. Each of the pair of arm resistance assemblies is operable independently of each other. Each of the pair of leg resistance assemblies has a surface suitable for receiving a human foot thereon. The pair of leg resistance assemblies are operable independently of each other.

The frame of the present invention includes a bottom beam having a longitudinal axis, a first pair of uprights extending upwardly transverse to the longitudinal axis of the bottom beam, a second pair of uprights extending from the bottom beam upwardly in transverse relationship to the longitudinal axis of the bottom beam, and a transverse beam extending upwardly from the bottom beam. The pair of arm resistance assemblies are supported by the first pair of uprights. The pair of leg resistance assemblies are supported by the second pair of uprights. The torso support is affixed to the transverse beam. The frame also has a first cross beam affixed to the bottom beam adjacent the one end of the frame and a second cross beam affixed to the bottom beam adjacent the opposite end of the frame. A first base is affixed to a bottom of the first cross beam and a second base is affixed to a bottom of the cross beam. Each of the first and second bases has a surface area greater than a surface area of the bottom of the cross beam.

The pair of arm resistance assemblies extend in a horizontal plane. The pair of leg resistance assemblies also extend in the same horizontal plane in which the pair of arm resistance assemblies extend.

The pair of arm resistance assemblies includes a first arm resistance assembly and a second arm resistance assembly. The first arm resistance assembly is parallel to and coplanar with the second arm resistance assembly. Each of the pair of arm resistance assemblies includes a rod affixed to the frame, a sleeve extending over the exterior surface of the rod and slidably mounted in relation thereto, and a resisting means for resisting the slidable movement of the sleeve on the rod. The surface for receiving a human hand is affixed to the sleeve. The resisting means, in the preferred embodiment of the present invention, comprises a spring that is mounted over and around the rod. The spring has an end bearing against the sleeve. The rod has a stop surface extending outwardly therefrom. The spring has an opposite end bearing against the stop surface.

The surface for receiving the human hand comprises, in the preferred embodiment of the present invention, a handle extending outwardly of the sleeve in transverse relationship to the rod. In an alternative embodiment of the present invention, the surface for receiving a human had is a panel that extends outwardly of the sleeve. This panel extends in transverse relationship to a longitudinal axis of the rod. The panel is pivotally mounted to the sleeve. The panel has a bottom surface connected thereto and is suitable for supporting a human wrist thereon. The bottom surface extends at an obtuse angle with respect to the panel.

Each of the pair of leg resistance assemblies comprises a rod affixed to the frame, a sleeve extending over the exterior surface of the rod and slidably mounted in relation thereto, and a resisting means for resisting the slidable movement of the sleeve on the rod. The surface for receiving the foot is affixed to the sleeve. The resisting means, in the preferred embodiment of the present invention, comprises a spring that is mounted over and around the rod. The spring has an end bearing against the sleeve. The surface for receiving the human foot comprises a foot receptacle pivotally affixed to the sleeve and extending outwardly therefrom. The foot receptacle includes a panel, a plate affixed to or formed at a bottom of the panel and extending in generally transverse relationship therewith, and a surface affixed to or formed on the plate and extending in transverse relationship thereto. The surface extends in parallel planar relationship to the panel. The panel is suitable for receiving the sole of the foot thereagainst. The plate and the surface suitable for receiving toes of the foot.

The torso support includes a generally horizontal surface supported by the frame. The generally horizontal surface is positioned generally centrally of a length of the frame in a location between the pair of arm resistance assemblies and the pair of leg resistance assemblies. The torso support can includes a stomach support member supported by the frame in a location adjacent the pair of leg resistance assemblies and a chest support member supported by the frame in a location adjacent to the pair of arm resistance assemblies. A stomach support member is in spaced relation to the chest support member. The stomach support member has a height that is greater than a height of the chest support member.

This foregoing section is intended to describe, in generality, the preferred embodiment of the present invention. It is understood that modifications to this preferred embodiment can be made within the scope of the present invention. As such, this section should not be construed, in any way, as limiting of the scope of the present invention. The present invention should only be limited by the following claims and their legal equivalents.

DETAILED DESCRIPTION OF THE INVENTION

Figure 1:
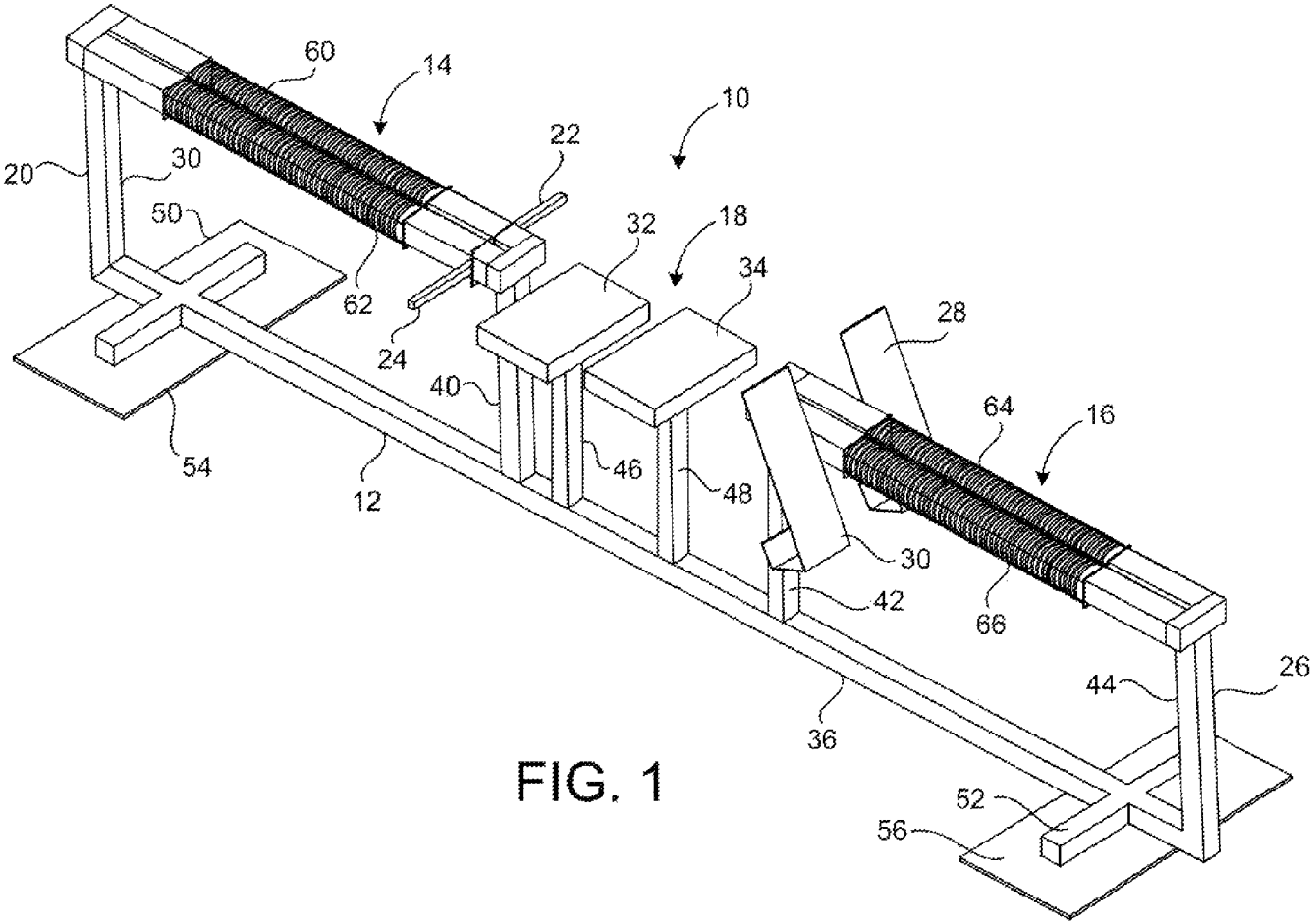
FIG. 1 is a perspective view of the exercise apparatus in accordance with the preferred embodiment of the present invention.

Referring to FIG. 1, there is shown the total body conditioning exercise apparatus 10 in accordance with the preferred embodiment of the present invention. The total body conditioning exercise apparatus 10 has a frame 12, a pair of arm resistance assemblies 14, a pair of leg resistance assemblies 16, and a torso support 18. The pair of arm resistance assemblies 14 are supported by the frame 12 adjacent an end 20 of the frame 12. Each of the pair of arm resistance assemblies 14 has surfaces 22 and 24 suitable for receiving a human hand thereon. Each of the pair of arm resistance assemblies 14 is operable independently of each other.

The pair of leg resistance assemblies 16 are supported by the frame 12 adjacent an opposite end 26 of the frame 12. The pair of leg resistance assemblies 16 has surfaces 28 and 30 suitable for receiving a human foot thereon. The pair of leg resistance assemblies 16 are operable independently of each other. The torso support 18 is supported by the frame 12 and has surfaces 32 and 34 thereon suitable for supporting a human torso.

As can be seen in FIG. 1, the frame 12 has a bottom beam 36 having a longitudinal axis. The bottom beam 36 is suitable for being supported directly upon or slightly above an underlying surface. There is a first pair of uprights 38 and 40 that extend upwardly in transverse relationship to the longitudinal axis of the bottom beam 36. The first pair of uprights 38 and 40 supports the pair of arm resistance assemblies 14. A second pair of uprights 42 and 44 extend upwardly from the bottom beam 36 in transverse relationship thereto. The pair of leg resistance assemblies 16 are supported by the second pair of uprights 42 and 44. A first transverse beam 46 supports the torso support surface 32 thereon. Another transverse beam 48 supports the torso support platform 34 thereon. The transverse beams 46 and 48 extend upwardly from the bottom beam 36 in transverse relationship thereto. The frame 12 also has a first cross beam 50 affixed to the bottom beam 36 adjacent the end 20 of the frame 12. A second cross beam 52 is affixed to the bottom beam 36 generally adjacent the opposite end 26 of the frame 12. A first base 54 is affixed to the bottom of the first cross beam 50. A second base 56 is affixed to the bottom of the second cross beam 52. As can be seen in FIG. 1, each of the bases 54 and 56 have a surface area greater than a surface area of the bottom of the respective cross beams 50 and 52.

The frame 12 of the present invention can be modular frame. In particular, the various components can be linked together by suitable telescoping pipes that can be linked or joined to one another. As such, assembly and disassembly can be carried out in a simple and convenient manner. The bases 54 and 56 serve to distribute forces that are applied to the frame 12 over a wider surface area so as to avoid any damage to the underlying surface. The bases 54 and 56 serve to support the bottom beam 36 slightly above the underlying surface so as to further avoid damage to any underlying surface. These bases 54 and 56 can be in the nature of pads, or other similar planar members, that can provide a cushioning effect. The frame 12 should have a suitable structural integrity so as to support the weight of the user thereupon. Additionally, the frame should be suitably strong so as to accommodate the forces thereapplied to the first pair of arm resistance assembly 10 and the second second pair of arm resistance assembly 16. The strong structural strength of the frame 12 will avoid any deformation or deflection during use. As such, the present invention provides a sturdy and stable support for the user.

In FIG. 1, it can be seen that the pair of arm resistance assemblies 14 extend in the same horizontal plane as the pair of leg resistance assemblies. As such, the pair of arm resistance assemblies 14 will be in generally longitudinal alignment with the pair of leg resistance assemblies 16.

The pair of arm resistance assemblies 14 includes a first arm resistance assembly 60 and a second arm resistance assembly 62. The arm resistance assembly 60 is in parallel and coplanar spaced relationship to the arm resistance assembly 62. Similarly, the leg resistance assembly 16 includes a first leg resistance assembly 64 and second leg resistance assembly 66. The first leg resistance assembly 64 will be in parallel and coplanar relationship with the second leg resistance assembly 66.

It can be seen that the torso support platform 18 includes a first torso support surface 32 and a second torso support surface 34. The first torso support surface 32 is a chest support member that is supported by the transverse beam 46 in a location generally adjacent to the first pair of arm resistance assemblies 14. The second torso support surface 34 is a stomach support member that is supported by the transverse beam 48 in spaced relationship to the first torso support surface 32. The second torso support surface 34 will be generally adjacent to the pair of leg resistance assemblies 16. The torso support platform 18 will be located generally centrally of the frame 12 in a location between the first arm resistance assemblies 14 and the second arm resistance assemblies 16.

Figure 2:
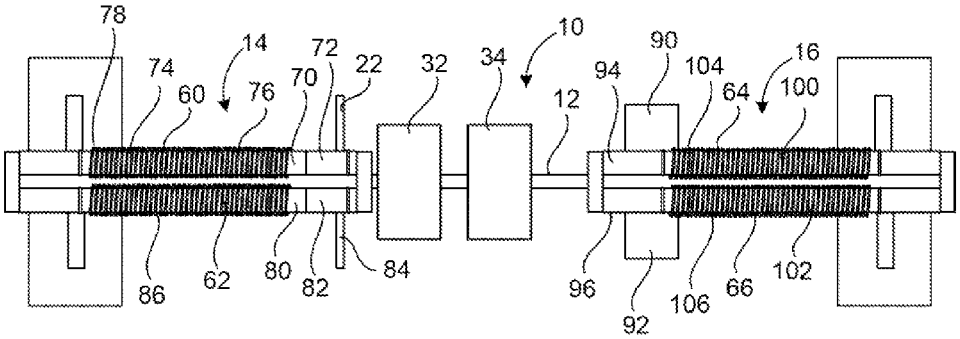
FIG. 2 is a plan view of the exercise apparatus of the preferred embodiment of the present invention.

Referring to FIG. 2, the total body conditioning exercise apparatus 10 is illustrated in a plan view. In FIG. 2, the pair of arm resistance assemblies 14 and the pair of leg resistance assemblies 16 are particularly illustrated. The pair of arm resistance assemblies 14 includes a first arm resistance assembly 60 and a second arm resistance assembly 62. It can be seen that the first arm resistance assembly 60 is in spaced parallel relationship to the second arm resistance assembly 62. The first arm resistance assembly 60 includes a rod 70 with a sleeve 72 extending over the exterior surface of the rod 70. The sleeve 72 is slidably mounted in relation to the rod 70. The sleeve 72 has the surface 22 suitable for receiving a human hand thereon. It can be seen that the surface 22 is in the nature of a handle. This handle extends outwardly of the sleeve 72 in generally transverse relationship to a longitudinal axis of the rod 70. A resisting means 74 is placed over the rod 70. The resisting means 74 serves to resist the slidably movement of the sleeve 72 over the rod 70. In the preferred embodiment of the present invention, the resisting means 74 is a spring 76. Spring 76 is applied around the exterior surface of the rod 70 so as to have one end bearing against the end of the sleeve 72 and the other end bearing against a stop surface 78. It should be noted that, within the concept of the present invention, this "resisting means" can include various other arrangements such as line connected to dead weights, leaf springs, belts, and elastomeric structures.

The second arm resistance assembly 62 also has a rod 80 with a sleeve 82 extending over and therearound. Sleeve 82 is in slidable relationship to the rod 80. A handle 84 provides the surface for receiving a human hand thereon. Handle 84 will extend outwardly in transverse relationship to the longitudinal axis of the rod 80. A spring 86 is mounted over the rod 80 so as to provide resistance to the sliding movement of the sleeve 82 relative to the rod 80.

The pair of leg resistance assemblies 16 has a configuration similar to that as the pair of arm resistance assemblies 14. In particular, there is a first leg resistance assembly 64 and a second leg resistance assembly 66. A foot receptacle 90 serves as the surface 28 for receiving a human foot therein. Another foot receptacle 92 also serves as the surface for receiving the other human foot therein. The foot receptacles 90 and 92 are affixed to respective sleeves 94 and 96 that are mounted on respective rods 100 and 102. The "resisting means" can have various structures, as described hereinabove. However, the preferred embodiment of the present invention would have a first spring 104 mounted over the rod 100 so as to bear against the sleeve 94. A spring 106 will be mounted over the rod 102 so as to provide resistance against the movement of the sleeve 96.

It should be noted that, within the concept of the present invention, the first arm resistance assembly 60 will be movable independently of the second arm resistance assembly 62. Similarly, the first leg resistance assembly 64 will be movable independently of the movement of the second leg resistance assembly 66.

The torso support surfaces 32 and 34 are located generally centrally of the frame 12. The first torso support surface 32 will be adjacent to the inner end of the first arm resistance assembly 60. The second torso support surface 34 will be located in slightly spaced relationship to the inner end of the pair of leg resistance assemblies 16. In this arrangement, the first torso support surface 32 will provide support for the chest of the user. The second torso support surface 34 will provide support for the stomach of the user.

After experimentation with the present invention, it has been found that the torso support surfaces 32 and 34 are very important for the conditioning of the user. In order to carry out the necessary exercise, the user will tighten his or her abdominal and stomach muscles in order to maintain balance and maintain a proper position on the exercise apparatus 10. As such, the movement of the arm resistance assemblies 14 and the movement of the leg resistance assemblies 16 will enhance this tightening of stomach and abdominal muscles of the user. Without the support surfaces 32 and 34, the user will be unable to maintain the exercise on the apparatus for an extended length of time. As conditioning improves, the user can remove one of the support surfaces 32 and 34 so as to create further strengthening of the stomach and abdominal muscles as desired.

Figure 3:
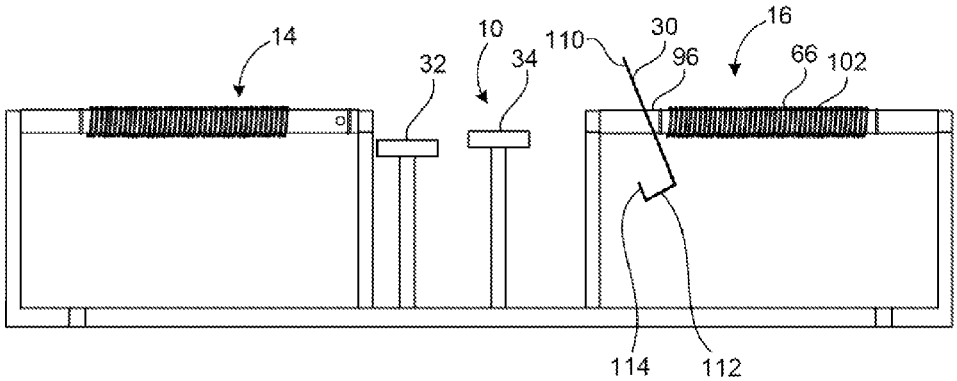
FIG. 3 is a side elevational view of the exercise apparatus of the preferred embodiment of the present invention.

FIG. 3 is a side elevational view of the total body conditioning exercise apparatus 10. In FIG. 3, it can be seen that the first torso support surface 32 has a height which is lower than the height of the second torso support surface 34. As such, the second torso support surface 34 will tightly bear against the stomach of the user. This will push in the stomach muscle to a desired degree so that proper resistance exercise to the stomach muscles in achieved. The first torso support surface 32 will lower the chest to a level in which the shoulders of the user will be aligned with the pair of arm resistance assemblies 14.

The leg resistance assemblies 16 include a surface 30 suitable for receiving a human foot therein. In FIG. 3, it can be seen that this surface 30 for receiving a human foot therein includes a panel 110, a plate 112, and a surface 114. The panel 110 will have a length and size suitable for allowing the sole of the foot of the user to be placed thereagainst. The plate 112 will extend in generally transverse relationship to the plane of the panel 110. Similarly, the surface 114 will extend in transverse relationship to the plane of the plate 112. The surface 114 will extend in generally parallel relationship to the panel 110. The arrangement of the panel 110, the plate 112 and the surface 114 will serve to constrain the toes of the foot of the user within the foot resistance assembly. The surface 30 for receiving a foot therein will be pivotally mounted to the sleeve 96. The other foot receptacle 90 will have a similar configuration. This pivotal connection will allow for a natural alignment for the human ankle. As such, the plate 30 will extend generally angularly with respect to the longitudinal axis of the rod 102 of the leg resistance assembly 66. This greatly improves the ergonomic characteristics of the exercise device 10 of the present invention.

Figure 4:
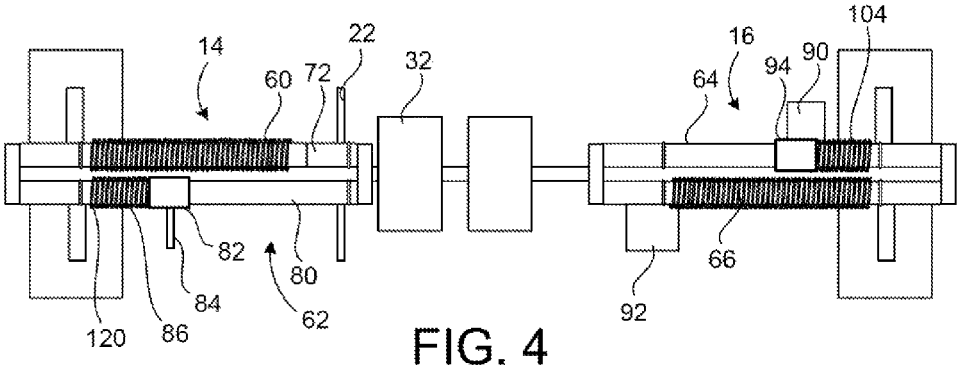
FIG. 4 is a plane view of the exercise apparatus of the present invention showing the movement of the arm and leg resistance assemblies.

FIG. 4 illustrates the natural movement of the pair of arm resistance assemblies 14 and the pair of leg resistance assemblies 16. In particular, it can be seen that the sleeves 82 of the second arm resistance assembly 62 has been moved along the length of the rod 80 so as to compress the spring 86 against the stop surface 120. The first arm resistance assembly 60 remains fully extended such that the sleeve 72 is in its unextended position. In normal use, the user will grasp the handle 84 so as to push the sleeve 82 along the rod 80 until the user can no longer overcome the resistance of the spring 86. The sleeve 82 can be returned back to the unextended position adjacent to the first torso support surface 32. The user can then apply force with the other hand onto the handle 22 of the first arm resistance assembly 60 so as to apply a similar force. As a result, a back-and-forth movement of the arms is achieved.

In FIG. 4, it can be seen that the pair of leg resistance assemblies 16 are operated such that the sleeve 94 associated with foot receptacle 90 has been pushed inwardly so as to compress the spring 104. The second leg resistance assembly 66 remains unextended. After this application of force has been achieved, the force can be released and then applied to the foot receptacle 92 associated with the second leg resistance assembly 66. In the preferred method of operation, the second arm resistance assembly 62 will be pushed at the same time that the first leg resistance assembly 64 is pushed. Similarly, the first arm resistance assembly 60 will be pushed at the same time that the second leg resistance assembly 66 is pushed. As such, a proper and balanced method of operation is achieved. However, the user may desire to alternate procedures, as they desire.

Figure 5:
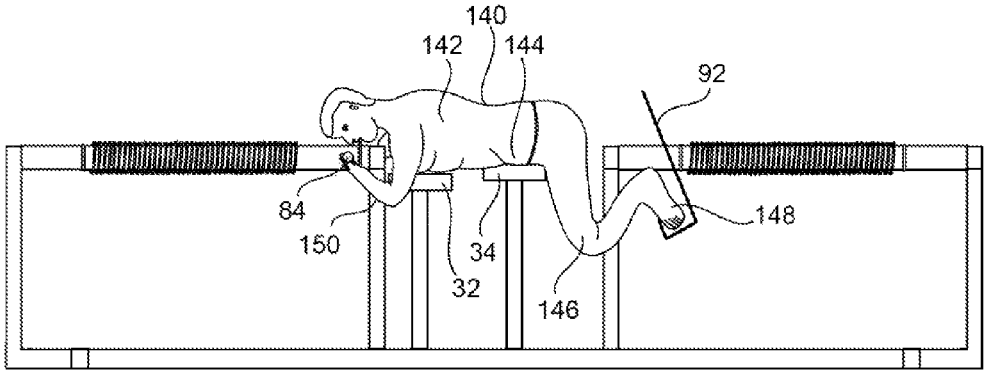
FIG. 5 is a side elevational view showing the positioning of human body on the exercise apparatus of the present invention.

FIG. 5 illustrates a user 140 as positioned on the first torso support surface 32 and the second torso support surface 34. It can be seen that the chest 142 of the user 140 rests upon the top of the first torso support surface 32. A stomach 144 of the user 140 is placed upon the top of the second torso support surface 34. The legs 146 of the user are bent in a natural crawling-type motion such that the feet 148 is received within the foot receptacle 92. Similarly, the arm 150 of the user 140 will grasp the handle 84.

Figure 6:
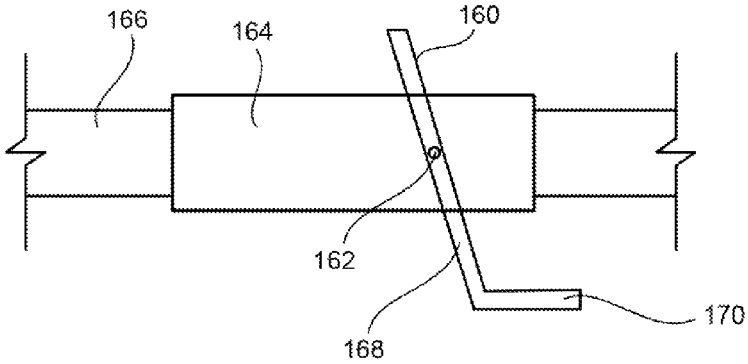
FIG. 6 is a side elevational view showing an alternative embodiment of the surface for receiving a human hand on the arm resistance assembly of the present invention.

FIG. 6 shows an alternative embodiment of the surface 160 for receiving a human hand thereon. It can be seen that the surface 160 is pivotally attached at pivot point 162 to the sleeve 164. Sleeve 164 is slidably placed upon a rod 166. The surface 160 includes a panel 168 that has a surface 170 at the bottom thereof. Surface 170 will extend in an obtuse angle with respect to the panel 168. As such, surface 170 will naturally receive the wrist of the hand of the user. The palm of the hand of the user can then bear against the surface 160 so as to achieve a natural "pushing" movement.

The total body conditioning exercise apparatus of the present invention is designed for the modern-day athlete and for any individuals that wished to achieve his or her maximum physical potential. The present invention is intended to allow the user to achieve the optimum level of physical development that is obtainable. The present invention is intended to support and enhance the natural physical development with an emphasis on eliminating atrophy in the muscles of the user. Normal activities in our lives begin with crawling and eventually mature to include walking, running, and swimming. These can be supplemented with exercising and weight training. The exercise apparatus of the present invention simulates the initial steps in human development of the crawling stage. As such, the present invention provides for a prone body position. The present invention achieves a correct natural movement of the human body and would conform with the crawling motion of an infant. The present invention provides incremental, constant resistance with constant motion. There is no negative impact on the body of the individual. These basics allow the user to experience unrestricted movement, constant motion, and constant resistance with a full range of motion and a correct natural motion. Ultimately, the total body conditioning exercise device of the present invention improves cardio, strength, reaction time and joint conditioning. It also serves to reduce stress levels, reduce muscle breakdown and reduce the tear down associated with conventional mainstream equipment.

The present invention can be utilized by institutions of higher development so as to allow a higher level of performance. The present invention is believed to provide an overall reduction of temporary and permanent injuries that would have, in the past, reduce the abilities of the athlete.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An exercise device comprising:

a frame;

a pair of arm resistance assemblies arranged in side-by-side relationship and supported by said frame adjacent one end of said frame, each of said pair of arm resistance assemblies having a surface extending transversely outwardly therefrom, said surface suitable for receiving a human hand thereon, each of said pair of arm resistance assemblies being operable independently of each other;

a pair of leg resistance assemblies arranged in side-by-side relationship and supported by said frame at an opposite end of said frame, each of said pair of leg resistance assemblies having a surface suitable for receiving a human foot thereon, said pair of leg resistance assemblies being operable independently of each other; said pair of arm resistance assemblies extending in a horizontal plane, said pair of leg resistance assemblies extending in generally the same horizontal plane in which said pair of arm resistance assemblies extend; and a torso support platform supported by said frame and having a surface thereof suitable for supporting a human torso thereon.

2. The exercise apparatus of claim 1, said frame comprising:

a bottom beam having a longitudinal axis;

a first pair of uprights extending upwardly in transverse relationship to said longitudinal axis of said bottom beam, said pair of arm resistance assemblies supported by said first pair of uprights;

a second pair of uprights extending from said bottom beam in transverse relationship thereto, said pair of leg resistance assemblies supported by said second pair of uprights; and a transverse beam extending upwardly from said bottom beam, said torso support platform being affixed to said transverse beam.

3. The exercise apparatus of claim 2, said frame further comprising:

a first cross beam affixed to said bottom beam adjacent said one end of said frame; and a second cross beam affixed to said bottom beam adjacent the opposite end of said frame.

4. The exercise apparatus of claim 3, said frame further comprising:

a first base affixed to a bottom of said first cross beam; and a second base affixed to a bottom of said second cross beam, each of said first and second bases having a surface area greater than a surface area of the bottom of the respective first and second cross beams.

5. The exercise apparatus of claim 1, said pair of arm resistance assemblies comprising a first arm resistance assembly and a second arm resistance assembly, said first arm resistance assembly being in parallel and coplanar relationship to said second arm resistance assembly.

6. The exercise apparatus of claim 1, each of said pair of arm resistance assemblies comprising:

a rod affixed to said frame, said rod having an exterior surface;

a sleeve extending over said exterior surface of said rod and slidably mounted in relation thereto, said surface for receiving the human hand being affixed to said sleeve; and a resisting means for resisting the slidable movement of said sleeve on said rod.

7. The exercise apparatus of claim 6, said resisting means comprising a spring mounted over and around said rod, said spring having an end bearing against said sleeve.

8. The exercise apparatus of claim 7, said rod having a stop surface extending outwardly therefrom, said spring having an opposite end bearing against said stop surface.

9. The exercise apparatus of claim 6, said surface for receiving the human hand comprising a handle extending outwardly of said sleeve in transverse relationship to said rod.

10. The exercise apparatus of claim 6, said surface for receiving the human hand comprising:

a panel extending outwardly of said sleeve, said panel extending in transverse relationship to a longitudinal axis of said rod, said panel having a surface thereon suitable for receiving a human palm thereagainst.

11. The exercise apparatus of claim 10, said panel being pivotally connected to said sleeve, said panel having a bottom surface connected thereto and suitable for supporting a human wrist thereon, said bottom surface extending at an obtuse angle with respect to said panel.

12. An exercise device comprising:

a frame;

a pair of arm resistance assemblies supported by said frame adjacent one end of said frame, each of said pair of arm resistance assemblies having a surface suitable for receiving a human hand thereon, each of said pair of arm resistance assemblies being operable independently of each other;

a pair of leg resistance assemblies supported by said frame at an opposite end of said frame, each of said pair of leg resistance assemblies having a surface suitable for receiving a human foot thereon, said pair of leg resistance assemblies being operable independently of each other; said pair of arm resistance assemblies extending in a horizontal plane, said pair of leg resistance assemblies extending in generally the same horizontal plane in which said pair of arm resistance assemblies extend; and a torso support platform supported by said frame and having a surface thereof suitable for supporting a human torso thereon, said pair of leg resistance assemblies comprising a first leg resistance assembly and a second leg resistance assembly, said first leg resistance assembly being in parallel and coplanar relation to said second leg resistance assembly, each of said pair of leg resistance assemblies comprising:

a rod affixed to said frame, said rod having an exterior surface;

a sleeve extending over said exterior surface of said rod and slidably movable in relation thereto, said surface for receiving a human foot being affixed to said sleeve; and a resisting means for resisting the slidable movement of said sleeve on said rod, said surface for receiving the human foot comprising a foot receptacle pivotally affixed to said sleeve and extending outwardly therefrom.

13. The exercise apparatus of claim 12, said resisting means comprising a spring mounted over and around said rod, said spring having an end bearing against said sleeve.

14. The exercise apparatus of claim 12, said foot receptacle comprising:

a panel;

a plate affixed to or formed at a bottom of said panel and extending in generally transverse relationship thereto; and a surface affixed or formed on said plate and extending in transverse relationship thereto, said surface extending in parallel planar relationship to said panel, said panel suitable for receiving the sole of the foot thereagainst, said plate and said surface suitable for receiving toes of the foot.

15. An exercise device comprising:

a frame;

a pair of arm resistance assemblies supported by said frame adjacent one end of said frame, each of said pair of arm resistance assemblies having a surface suitable for receiving a human hand thereon, each of said pair of arm resistance assemblies being operable independently of each other;

a pair of leg resistance assemblies supported by said frame at an opposite end of said frame, each of said pair of leg resistance assemblies having a surface suitable for receiving a human foot thereon, said pair of leg resistance assemblies being operable independently of each other; said pair of arm resistance assemblies extending in a horizontal plane, said pair of leg resistance assemblies extending in generally the same horizontal plane in which said pair of arm resistance assemblies extend; and a torso support platform supported by said frame and having a surface thereof suitable for supporting a human torso thereon, said torso support platform comprising a generally horizontal surface supported by said frame, said generally horizontal surface positioned generally centrally of a length of said frame in a location between said pair of arm resistance assemblies and said pair of leg resistance assemblies, said torso support platform comprising:

a stomach support surface supported by said frame in a location adjacent said pair of leg resistance assemblies; and a chest support surface supported by said frame in a location adjacent to said pair of arm resistance assemblies, said stomach support surface being in spaced relation to said chest support surface, said stomach support surface having a height that is greater than a height of said chest support surface, said stomach support surface adapted to receive a human stomach thereon, said chest support adapted to receive a human chest thereon.

* * * * *